US006971495B2

(12) United States Patent
Hedrick et al.

(10) Patent No.: US 6,971,495 B2
(45) Date of Patent: Dec. 6, 2005

(54) MASS FLOW HOPPER AND METHOD OF MANUFACTURE

(75) Inventors: Thomas W. Hedrick, 102 Larkspur La., Sikeston, MO (US) 63801; Jason P. South, Menan, ID (US)

(73) Assignees: Phillip Barry South, Idaho Falls, ID (US); Thomas W. Hedrick, Sikeston, MO (US)

( * ) Notice: Subject to any disclaimer, the term of this patent is extended or adjusted under 35 U.S.C. 154(b) by 0 days.

(21) Appl. No.: 10/660,148

(22) Filed: Sep. 11, 2003

(65) Prior Publication Data

US 2004/0052590 A1 Mar. 18, 2004

Related U.S. Application Data

(60) Provisional application No. 60/410,528, filed on Sep. 13, 2002.

(51) Int. Cl.[7] ..... B65G 11/00
(52) U.S. Cl. ..... 193/2 R; 52/197; 414/295
(58) Field of Search ..... 193/2 R; 52/197; 414/299

(56) References Cited

U.S. PATENT DOCUMENTS

| | | | | |
|---|---|---|---|---|
| 2,155,587 A | | 4/1939 | Fairbank | |
| 3,071,297 A | | 1/1963 | Lee | |
| 3,622,656 A | * | 11/1971 | Dewey et al. | 264/35 |
| 4,125,970 A | * | 11/1978 | Vidal | 52/31 |
| 4,282,988 A | | 8/1981 | Hulbert, Jr. | |
| 5,782,524 A | | 7/1998 | Heider et al. | |
| 6,055,781 A | * | 5/2000 | Johanson | 52/197 |

* cited by examiner

*Primary Examiner*—Joe Dillon, Jr.
(74) *Attorney, Agent, or Firm*—Workman Nydegger

(57) ABSTRACT

A method for forming a hopper in a storage structure includes mounting a form to a storage structure which bounds a compartment. The form can be flexible or rigid. A layer of cementitious material is applied over an exterior surface of the form so as to produce a rigid side wall. The rigid side wall has an interior surface bounding a progressively constricting flow channel that communicates with the compartment of the storage structure. In one embodiment, the layer of cementitious material is applied by spraying.

19 Claims, 9 Drawing Sheets

MASS FLOW HOPPER AND METHOD OF MANUFACTURE

CROSS-REFERENCE TO RELATED APPLICATIONS

This application claims priority to U.S. Provisional Patent Application Ser. No. 60/410,528, filed Sep. 13, 2002 which is incorporated herein by specific reference.

BACKGROUND OF THE INVENTION

1. The Field of the Invention

The present invention relates to mass flow hoppers and their method of manufacture and retrofitting.

2. The Relevant Technology

Bulk materials, such as grains, legumes, salt, and other granulated materials, have historically been stored in large silos prior to shipment for end use. A silo typically comprises: (1) a large storage compartment in which the bulk material is held, (2) a bulky feeder which controls the flow of the bulk material out of the silo, and (3) a substantially funnel shaped hopper which feeds the bulk material from the storage compartment to the bulky feeder. Silos are generally designed in an elevated upstanding configuration such that the bulk material can freely flow from the storage compartment, down through the hopper, and out through the bulky feeder solely under the force of gravity.

One of the critical factors in achieving free flow of bulk material through a silo is the configuration of the hopper. That is, the hopper must be shaped relative to the type of bulk material that is being stored. If the hopper has the wrong slope, curve, or other configuration, the bulk material can become blocked within the hopper. As some silos can hold hundreds of thousands of pounds of bulk material which bears against the material blocked within the hopper, clearing a blocked hopper can be a difficult, dangerous, and time consuming process.

Hoppers are typically made of large sections of prefabricated steel that are assembled within the base of the storage compartment by bolting and/or welding. Hoppers are currently designed using complex computer modeling programs so as to ensure a configuration that provides optimum flow for a given bulk material and is able to withstand the tremendous forces applied by the bulk material. One of the drawbacks of conventional hoppers and their method of manufacture is that it is very expensive and time consuming to fabricate a large steel hopper having the precise contour to optimize flow and then assemble the large heavy sections of the hopper within the storage compartment.

An additional problem with existing silos is that many of them were made prior to the development of the current computer modeling programs which ensure a design that optimizes flow properties. As such, some silos are subject to repeated blocking. In addition, in some situations it is desirable to change the bulk material that is being stored within a silo. In so doing, the hopper may no longer be configured to provide free flow of material. In each of the above situations, to make the silos functional it is necessary to cut out the original hopper and then construct a new hopper having the desired configuration. As with the formation of an original hopper, however, retrofitting a silo with a new hopper formed of prefabricated steel sections is an expensive and time consuming process.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

FIG. 8 is a cross-sectional side view of the assembly shown in FIG. 6 having a support layer and reinforcing formed thereon;

DETAILED DESCRIPTION OF THE PREFERRED EMBODIMENTS

The present invention is directed towards mass flow hoppers and manufacturing methods thereof in which the mass flow hoppers are configured to promote and optimize the free flow of bulk materials. In addition, the present invention relates to methods for retrofitting mass flow hoppers into preexisting storage facilities.

Figure 1:
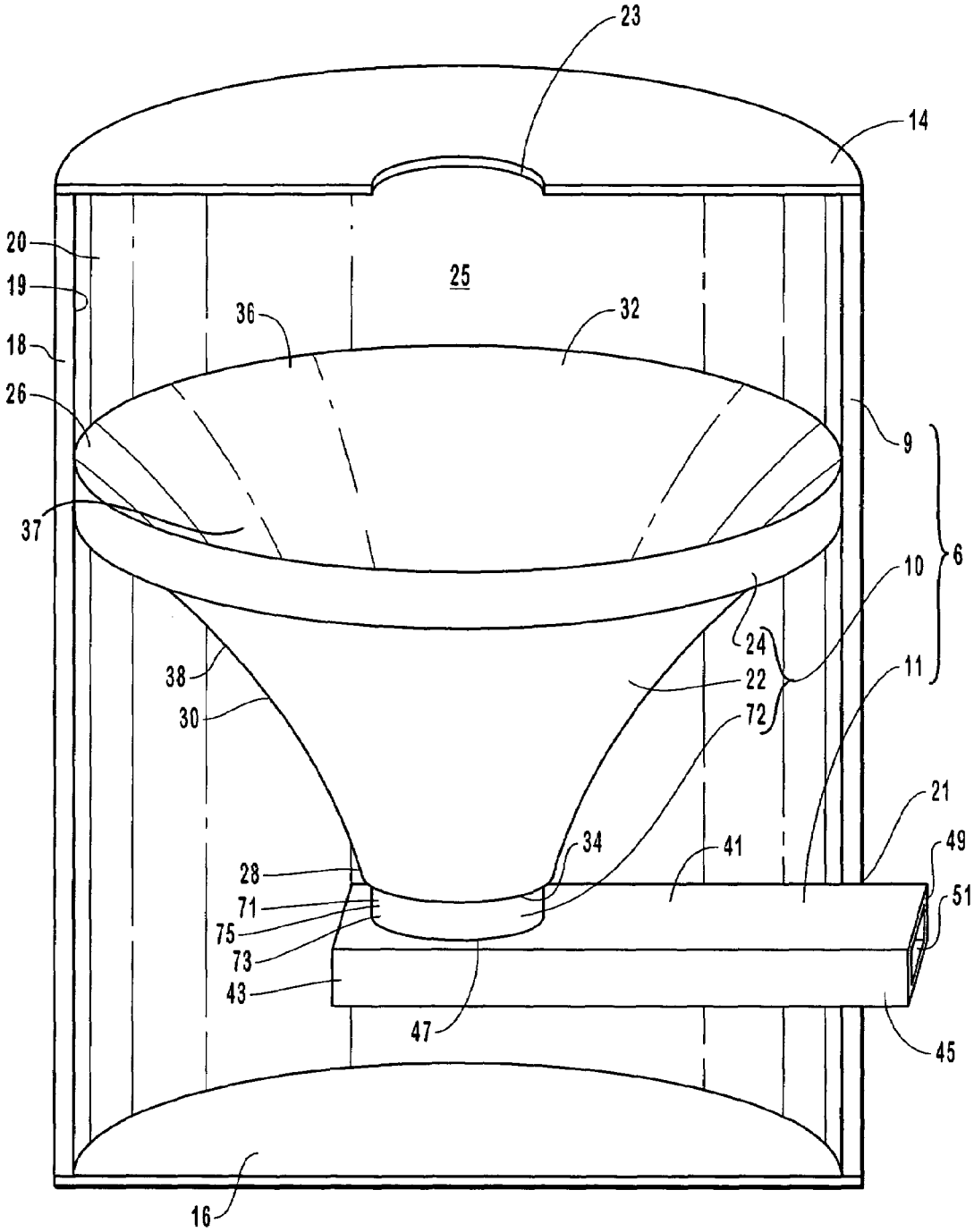
FIG. 1 is a perspective partially cut-away view of a storage structure having a hopper assembly installed therein.

Depicted in FIG. 1 is one embodiment of a storage facility 6 incorporating features of the present invention. In general, storage facility 6 comprises a storage structure 9, a hopper assembly 10, and a bulky feeder 11. Storage structure 9 may be any suitable storage facility such as a silo or storage bin which is configured to store bulk materials such as, but not limited to, grains, legumes, salt, cement, and other granulated or powdered materials.

In the embodiment depicted, storage structure 9 has a ceiling 14, a floor 16, and an annular boundary wall 18 extending therebetween. Boundary wall 18 has an interior surface 19 bounding a chamber 20. Although the storage structure 9 can be any size, by way of example, chamber 20 can have a volume greater than 1,000 cubic meters, greater than 15,000 cubic meters, or greater than 35,000 cubic meters. It is appreciated that storage structure 9 may have a variety of transverse configurations such as, but not limited to, circular, square, oval, polygonal, and the like. In this regard, boundary wall 18 can comprise a single continuous wall or a plurality of interconnected walls. Furthermore, in alternative embodiments, floor 16 and ceiling 14 are not required. For example, boundary wall 18 can have an open top and be supported off the ground by posts or other supporting structures.

Extending through ceiling 14 so as to communicate with chamber 20 is an inlet port 23. Inlet port 23 is configured to allow bulk material to be fed therethrough into chamber 20. In alternative embodiments, inlet port 23 can also be formed through boundary wall 18. As will be discussed below in greater detail, storage structure 9 also has at least one outlet port 21 to allow the bulk materials to be transferred out of chamber 20.

Hopper assembly 10 is installed within chamber 20 of storage structure 9 between ceiling 14 and floor 16. The portion of chamber 20 bounded between hopper assembly 10 and ceiling 14 is a storage compartment 25 configured to house the bulk material. Hopper assembly 10 comprises a hopper 22, a support beam 24, and an outlet assembly 72.

Hopper 22 comprises a sidewall 30 having a substantially funnel shaped interior surface 36 and an opposing exterior surface 38. Interior surface 36 bounds a progressively constricting flow channel 37 extending between an enlarged first end 26 bounding a first opening 32 and an opposing radially constricted second end 28 bounding a second opening 34. Sidewall 30 thus tapers like a funnel as it progresses from first opening 32 to second opening 34. Although hopper 22 can be any desired size, in one embodiment flow channel 37 has a volume greater than 5 cubic meters, greater than 40 cubic meters, or greater than 90 cubic meters.

In the embodiment shown in FIG. 1, interior surface 36 of sidewall 30 inwardly curves in a convex or hyperbolic shape. (See also FIG. 9.) The preferred configuration for hopper 22 is determined on a case-by-case basis using computer programs known to those skilled in the art. The configuration for interior surface 36 is designed to optimize a smooth continuous flow of the bulk material through hopper 22 without clogging. The configuration is typically based on factors such as the size of the storage structure and the flow properties of the material being stored. In other embodiments, the configuration for interior surface 36 need not be designed to an optimal configuration but can have a general configuration that provides for a range of flows.

Figure 1A:
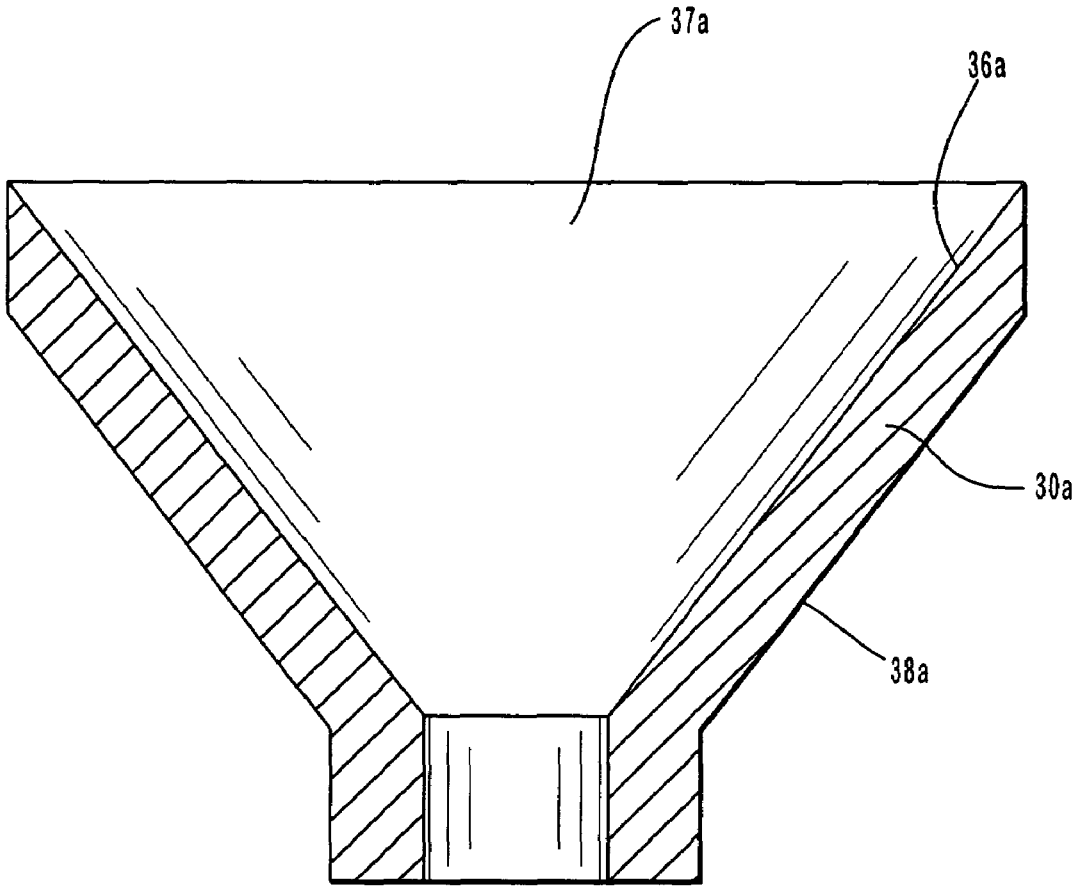
FIG. 1A is a cross sectional side view of an alternative embodiment of the hopper shown in FIG. 1.

In one embodiment, interior surface 36 of sidewall 30 is a smooth surface that gradually changes in radius of curvature as it extends from first opening 32 to second opening 34. In other embodiments, interior surface 36 can have a substantially constant radius of curvature, can be comprised of two or more discrete radius of curvatures, can comprise combinations of curved and linear sections, can comprise two or more different linear sections, and can comprise combinations of the above. For example, depicted in FIG. 1A is an alternative embodiment of a sidewall 30*a* having a linear interior surface 36*a* with a funnel configuration. Because the bulk material does not directly flow on exterior surface 38, exterior surface 38 can have a contour complementary to interior surface 36 or can be any other desired configuration.

Figure 2:
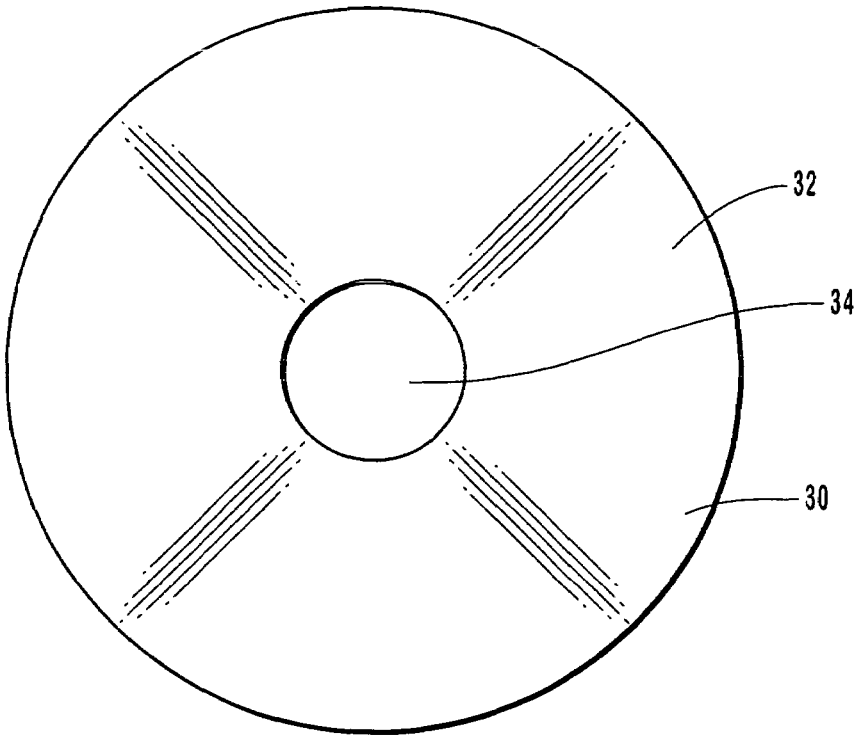
FIG. 2 is a top plan view of one embodiment of a hopper shown in FIG. 1.
Figure 3:
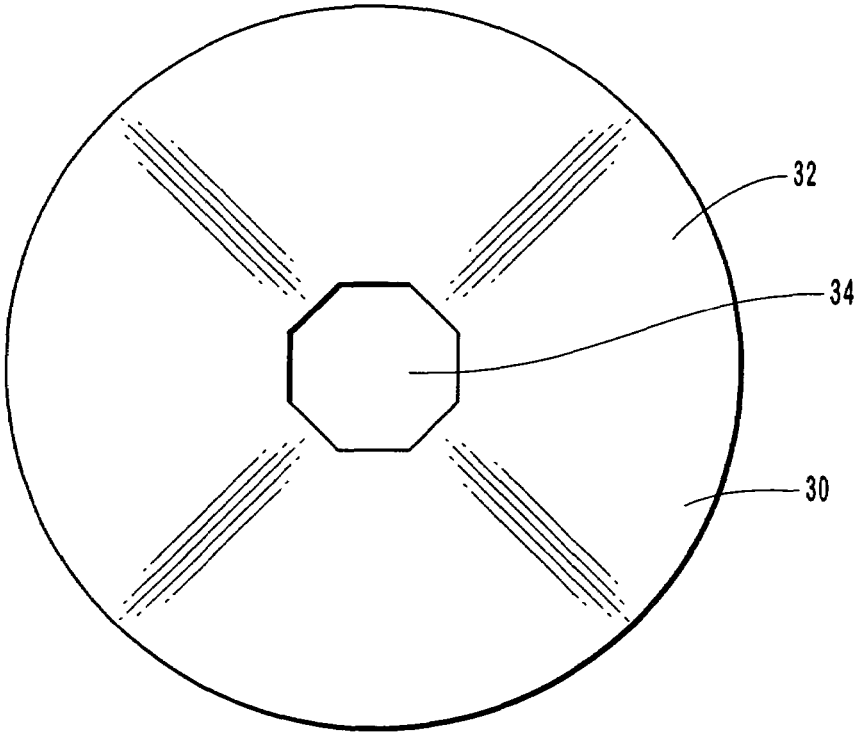
FIG. 3 is a top plan view of another embodiment of the hopper shown in FIG. 1.
Figure 4:
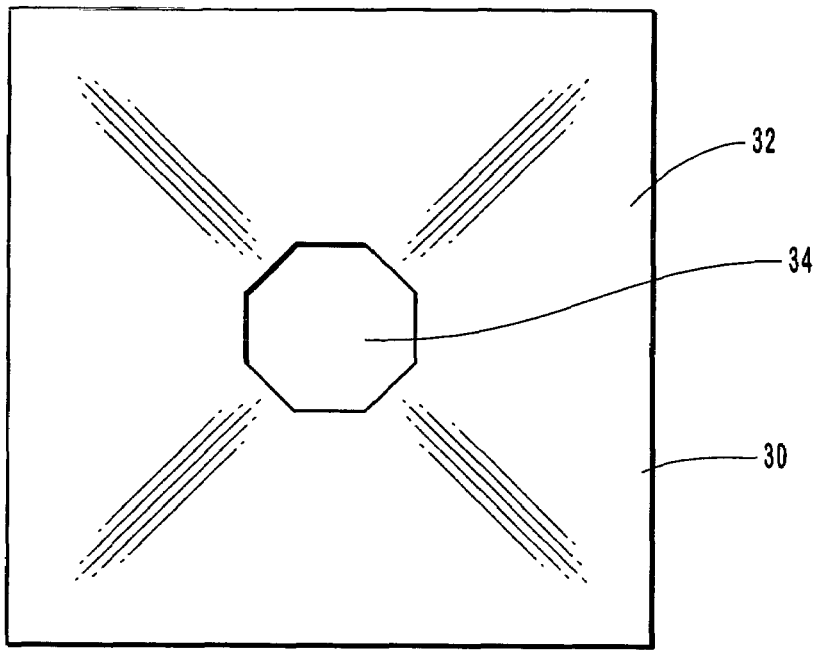
FIG. 4 is a top plan view of yet another embodiment of the hopper shown in FIG. 1.
Figure 5:
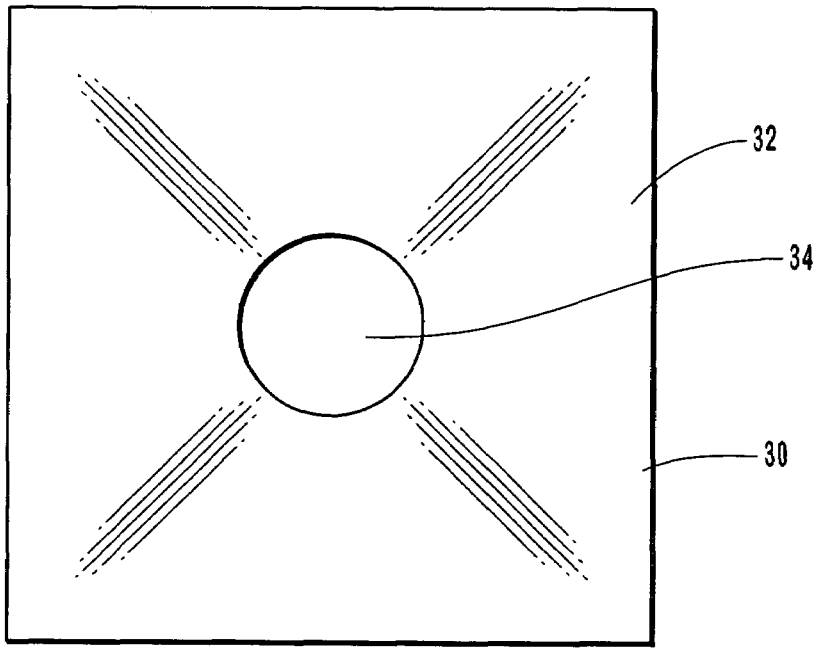
FIG. 5 is a top plan view of still another embodiment of the hopper shown in FIG. 1.

With reference to FIGS. 2–5, first opening 32 may have the same or a different shape than second opening 34. Generally, first opening 32 corresponds to the shape of storage structure 9. That is, if boundary wall 18 of storage structure 9 has a circular transverse cross section, first opening 32 also typically has a circular-shape (FIGS. 2 and 3). Similarly, if boundary wall 18 of storage structure 9 has a square transverse cross section, first opening 32 can also have a square shape (FIGS. 4 and 5). In contrast, however, second opening 34 does not have to have the same shape as first opening 32. For example, as shown in FIG. 3, first opening 32 has a circular shape while second opening 34 has an octagonal shape. Similarly, FIGS. 4 and 5 show embodiments of hopper 22 where first opening 32 has a different shape than second opening 34.

Support member 24 comprises an annular beam that radially inwardly projects from interior surface 19 of boundary wall 18 so as to encircle storage compartment 25. First end 26 of hopper 22 is integrally formed with support member 24 so that support member 24 structurally supports hopper 22 within chamber 20. In an alternative embodiment, support member 24 need not extend continuously around storage structure 9 but may be comprised of radially spaced apart segments which support hopper 22. If desired, a portion of hopper 22 can also be directly supported by boundary wall 18 of storage structure 9. As will be discussed below in greater detail, support member 24 and hopper 22 are typically comprised of a cementitious material, such as shotcrete, having a reinforcing member, such as conventional rebar, embedded therein.

As discussed below in greater detail, outlet assembly 72 comprises in part a tubular conduit 75 having a first end 71 and an opposing second end 73. Tubular conduit 75 is typically comprised of a metal such as steel. First end 71 of conduit 75 is coupled in fluid communication with second end 28 of hopper 22. As such, bulk material traveling through hopper 22 passes through conduit 75. As will be discussed below in more detail, outlet assembly 72 also functions in part to provide structural support for hopper 22 during the formation thereof. In alternative embodiments, conduit 75 can have the same alternative transverse cross sections as second end 28 of hopper 22. Alternatively, the portion of conduit 75 that is in communication with second opening 34 of hopper 22 may have a different geometric configuration.

Bulky feeder 11 is partially disposed within chamber 20 of storage structure 9 below hopper assembly 10. Bulky feeder 11 comprises a top surface 41 the extends between an inlet end 43 and an opposing outlet end 45. An inlet port 47 is formed on top surface 41 at inlet end 43. Second end 73 of conduit 75 is coupled in fluid communication with inlet port 47 of bulky feeder 11. Outlet end 45 of bulky feeder 11 outwardly projects through access 21 of storage structure 9 and terminates at an end face 49. A discharge port 51 is formed at end face 49. Although not shown, supports extend from floor 16 and/or boundary wall 19 so as to retain bulky feeder 11 in the desired position.

In the above configuration, bulk material stored in storage compartment 25 travels under the force of gravity down through hopper 22 and outlet assembly 72 and into bulky feeder 11. Conventional gates known to those skilled in the art are housed within bulky feeder 11 and can be selectively opened and closed. When the gates are in the open position, the bulk material freely flows through bulky feeder 11 and out discharge port 51. When the gates are closed, the flow of bulk material is stopped. Bulky feeder 11 may also assist urging material out of outlet assembly 72. It will be appreciated that bulky feeder 11 is exemplary of a variety of dispensing devices which may be used to assist in dispensing bulk materials from hopper 22.

The inventive hopper assemblies of the present invention allows for more efficient design and building of hoppers than was previously enabled under the prior art. Described below are examples of methods for manufacturing hopper assembly 10 incorporating features of the present invention.

Before manufacturing hopper assembly 10, a certain amount of preparatory work is helpful in order to ensure that an optimum design is achieved. For example, the engineers designing the hopper assembly should determine (1) the location of first end 26 of hopper 22 along boundary wall 18 of storage structure 9; (2) the configuration for hopper 22 to achieve optimal free flow of bulk material therethrough, the configuration being based largely on the properties of the bulk material being stored; and (3) based on the configuration of hopper 22 and the location of first end 26 of hopper 22, the location of second end 73 of outlet assembly 72.

Figure 6:
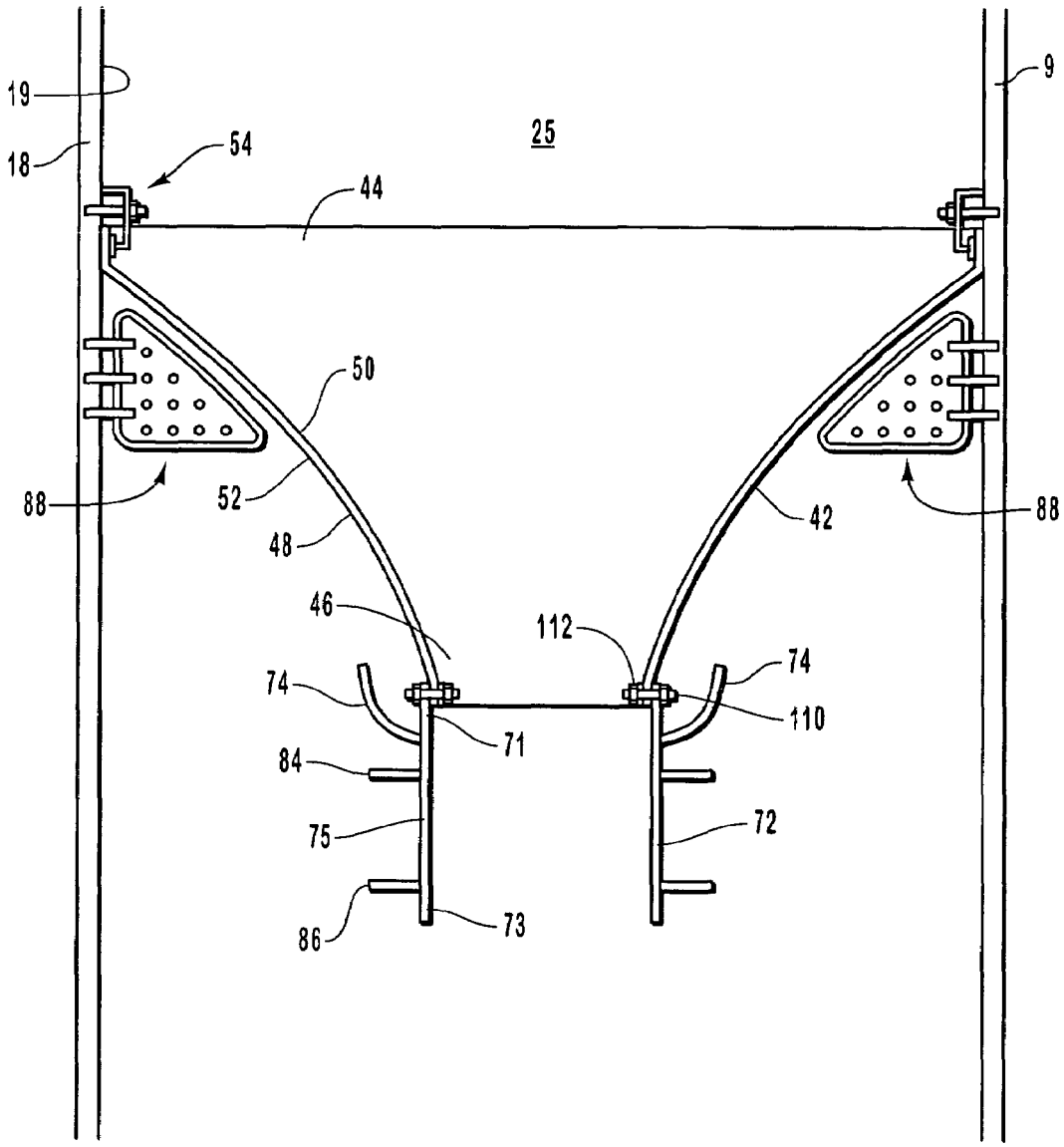
FIG. 6 is a cross-sectional side view of a form supporting an outlet assembly within a storage structure.

With reference to FIG. 6, once the above parameters are determined, a flexible form 42 is designed having a configuration corresponding to the determined configuration for hopper 22. That is, form 42 has a sidewall 48 having a funnel shaped configuration. Sidewall 48 has a interior surface 50 and an opposing exterior surface 52 extending between an enlarged first end 44 and a constricted second end 46. Form 42 is designed so that exterior surface 52 has a configuration corresponding to the desired configuration for interior surface 36 of hopper 22 as previously discussed. One of the benefits of using flexible form 42 is that it can be relatively easily formed to match the optimal computer generated contour for interior surface 36 of hopper 22. Interior surface 50 of flexible form 42 typically has the same contour as exterior surface 52, particularly where flexible form 42 is to be retained as part of hopper 22. Where flexible form 42 is removed, as will be discussed below, interior surface 50 can be any desired configuration.

In one embodiment, form 42 comprises a plurality of flexible, sheet-like panels that have been sewn, seamed, welded, crimped, or otherwise secured together so as to achieve the desired shape. In one embodiment, form 42 is comprised of a flexible sheet which is comprised of a polymeric material; fabric; a woven material comprised of natural, synthetic, and/or metallic fibers; mesh; chain link; a composite material with reinforcing; or combinations thereof. For example, the sheet can be formed from a cross laminate plastic, a reinforced plastic coated fabric, such as a polyvinyl chloride impregnated Dacron, or any other suitable material. Although not required, form 42 can be comprised of a lightweight gas and liquid impermeable flexible sheet. Furthermore, form 42 can be formed of one or more layers of material that are overlapping and/or secured together. In yet other embodiments, form 42 can be comprised of a single sheet or layer of material that is selectively seamed, sewn, or otherwise contoured to obtain the desired configuration.

Figure 7:
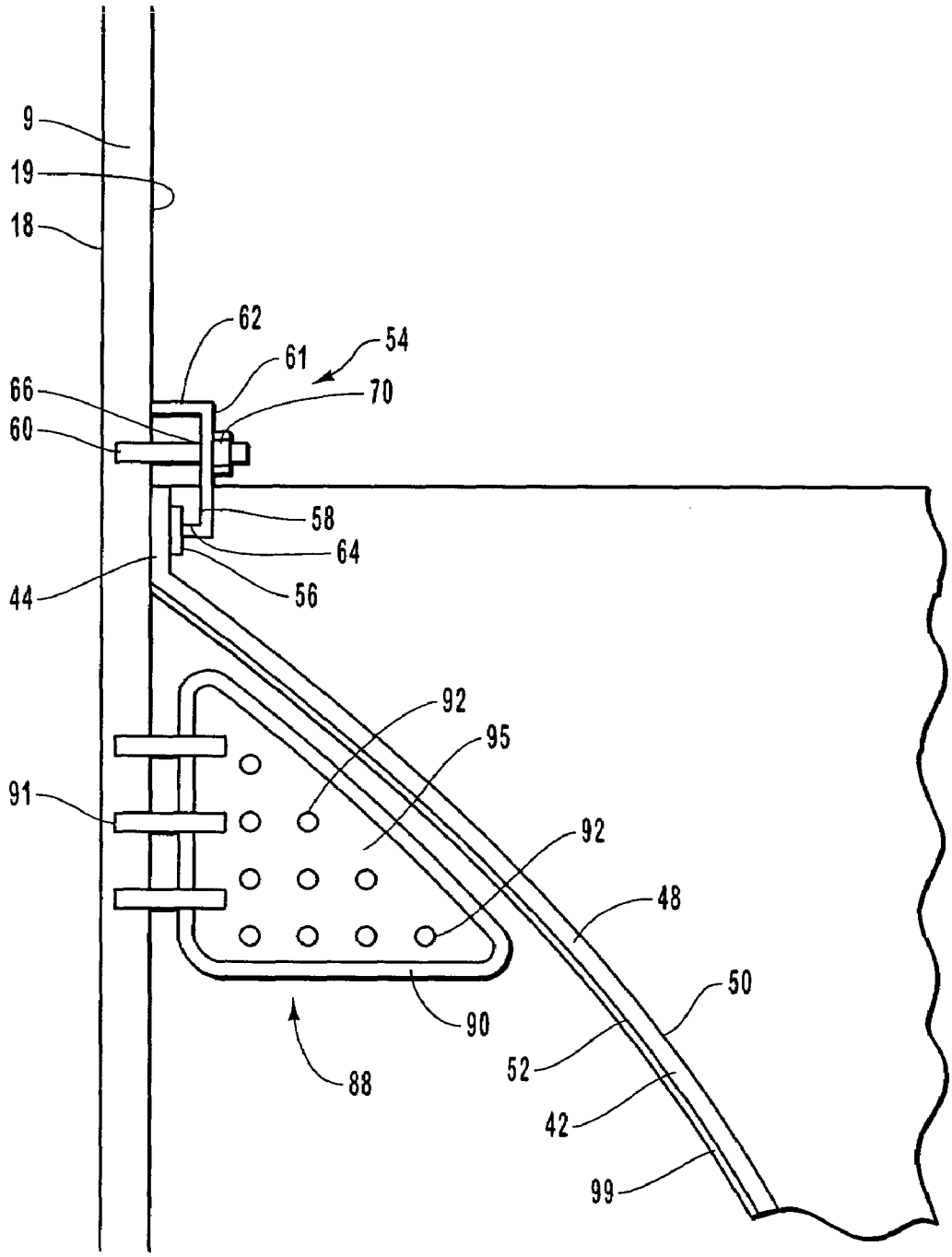

Once form 42 is created, first end 44 of form 42 is secured to boundary wall 18 of storage structure 9 by an anchoring assembly 54. Anchoring assembly 54 is one means for removably securing form 42 to boundary wall 18 of storage structure 9. As best shown in FIG. 7, anchoring assembly 54 comprises a plurality of plates 56, clamps 58, and bolts 60. Bolts 60 are securely mounted to boundary wall 18 at radially spaced apart locations so as to inwardly project from interior surface 19 of boundary wall 18. Bolts 60 are disposed in a substantially horizontal plane adjacent to the location for first end 26 of hopper 22.

Once bolts 60 are secured, clamps 58 are mounted thereon. Each clamp 58 has a substantially C-shaped transverse cross section and comprises a back 61 having a first leg 62 and a spaced apart second leg 64 projecting therefrom. A plurality of longitudinally spaced part apertures 66 extend through back 61. Apertures 66 are configured such that clamps 58 can be received over bolts 60 so that bolts 60 pass through corresponding apertures 66. Once clamps 58 are received on bolts 60, a nut 70 is threaded onto each bolt 60 so as to selectively advance clamps 58 toward boundary wall 18.

First end 44 of form 42 is disposed between second leg 64 of clamps 58 and boundary wall 18. Similarly, plates 56 are positioned between first end 44 of form 42 and second leg 64 of clamps 58. In this position, nuts 70 are tightened on bolts 60 so that second leg 64 of clamps 58 bias first end 44 of form 42 against boundary wall 18. As a result, first end 44 of form 42 is removably secured to boundary wall under frictional engagement. Plates 56 provide a large gripping surface and more uniformly distribute the biasing force over first end 44 of form 42. In alternative embodiments, however, plates 56 are not required. For example, in contrast to using plates 56, a retention member, such as a rod, can be secured to first end 44 of form 42. In one embodiment the retention member is received within a loop formed at first end 44 of form 42. The retention member can then be received between legs 62 and 64 of clamps 58. By biasing clamps 58 against boundary wall 18, the retention member and thus first end 44 of form 42 is captured between legs 62 and 64 of clamps 58. In yet other embodiments, it is appreciated that form 42 can be secured to boundary wall 18 by being directly connected to bolts 60 or by using other conventional clamps, fasteners, and the like.

Returning to FIG. 6, with first end 44 of form 42 secured to boundary wall 18, second end 46 of form 42 is freely suspended within chamber 20. Attached to second end 46 of form 42 is outlet assembly 72. As previously discussed, outlet assembly 72 comprises tubular conduit 75 having first end 71 and opposing second end 73. Conduit 75 can be made of any material capable of withstanding the related forces and wear. In one embodiment conduit 75 is made of steel having a thickness in a range from about 1 cm to about 3 cm.

Radially outwardly projecting from conduit 75 at first end 71 are a plurality of spaced apart stud anchors 74. An annular upper flange 84 encircles and radially outwardly projects from conduit 75 below stud anchors 74. An annular lower flange 86 encircles and radially outwardly projects from conduit 75 at or toward second end 73 of conduit 75. In one embodiment, upper flange 84 is rigidly fixed to conduit 75 while lower flange 86 can be selectively adjusted along the length of conduit 75.

The present invention includes means for removably securing conduit 75 to second end 46 of form 42. By way of example and not by limitation, a plurality of spaced apart bolts 110 are mounted to first end 71 of conduit 75 so as to radially project inward therefrom. Second end 46 of form 42 is received within first end 71 of conduit 75. The free end of bolts 110 are then passed through corresponding holes formed in second end 46 of form 42. Large gaskets 112 are received over bolts 110 following which nuts 114 are threaded onto bolts 110. As nuts 114 are tightened, second end 46 of form 42 is compressed between gaskets 112 and the interior surface of conduit 75, thereby securing conduit 75 to form 42. In alternative embodiments, it is appreciated that there are a number of other conventional clamps, fasteners, and the like that can be used to removably secure conduit 75 to form 42.

Outlet assembly 72 assists in a number of different functions. For example, outlet assembly 72 function as a weight holding down second end 46 of form 42. That is, as a result of the weight of outlet assembly 72, form 42 is securely held in the desired configuration for forming hopper 22. Outlet assembly 72 also functions as the mechanism for coupling hopper 22 to bulky feeder 11. In one embodiment, conduit 75 is purposely configured longer than is necessarily. Once hopper 22 is fully formed, conduit 75 can be easily cut to the desired length by way of a torch or other cutting tool.

As also shown in FIG. 6, an annular frame assembly 88 is mounted to interior surface 19 of boundary wall 18 so as to radially project inward therefrom. Frame assembly 88 provides the foundation for support beam 24 and is disposed at a spaced apart location below first end 44 of form 42. It is appreciated that frame assembly 88 may be installed before or after form 42.

As best shown in FIG. 7, frame assembly 88 comprises a plurality of vertically disposed, radially spaced apart triangular torsion rings 90. Torsion rings 90 are mounted to boundary wall 18 of storage structure 9 by one or more bolts 91. Other conventional fasteners or ties can also be used. In this configuration, torsion rings 90 are spaced apart from boundary wall 18 and spaced apart from form 42. Torsion rings 90 are typically spaced apart from each other in a range between about 15 cm to about 30 cm with each torsion ring 90 bounding a central opening 95.

Extending through central openings 95 of torsion rings 90 are a plurality of strands of reinforcing rod 92. In one embodiment, reinforcing rod 92 comprises conventional steel rebar formed in a loop so as to circle through torsion rings 90. The plurality of reinforcing rods 92 are secured within torsion rings 90 by ties or other fasteners extending from torsion rings 90. It is appreciated that torsion rings 90 and reinforcing rod 92 can be attached to boundary wall 19 in discrete sections and then tied together.

Figure 8:
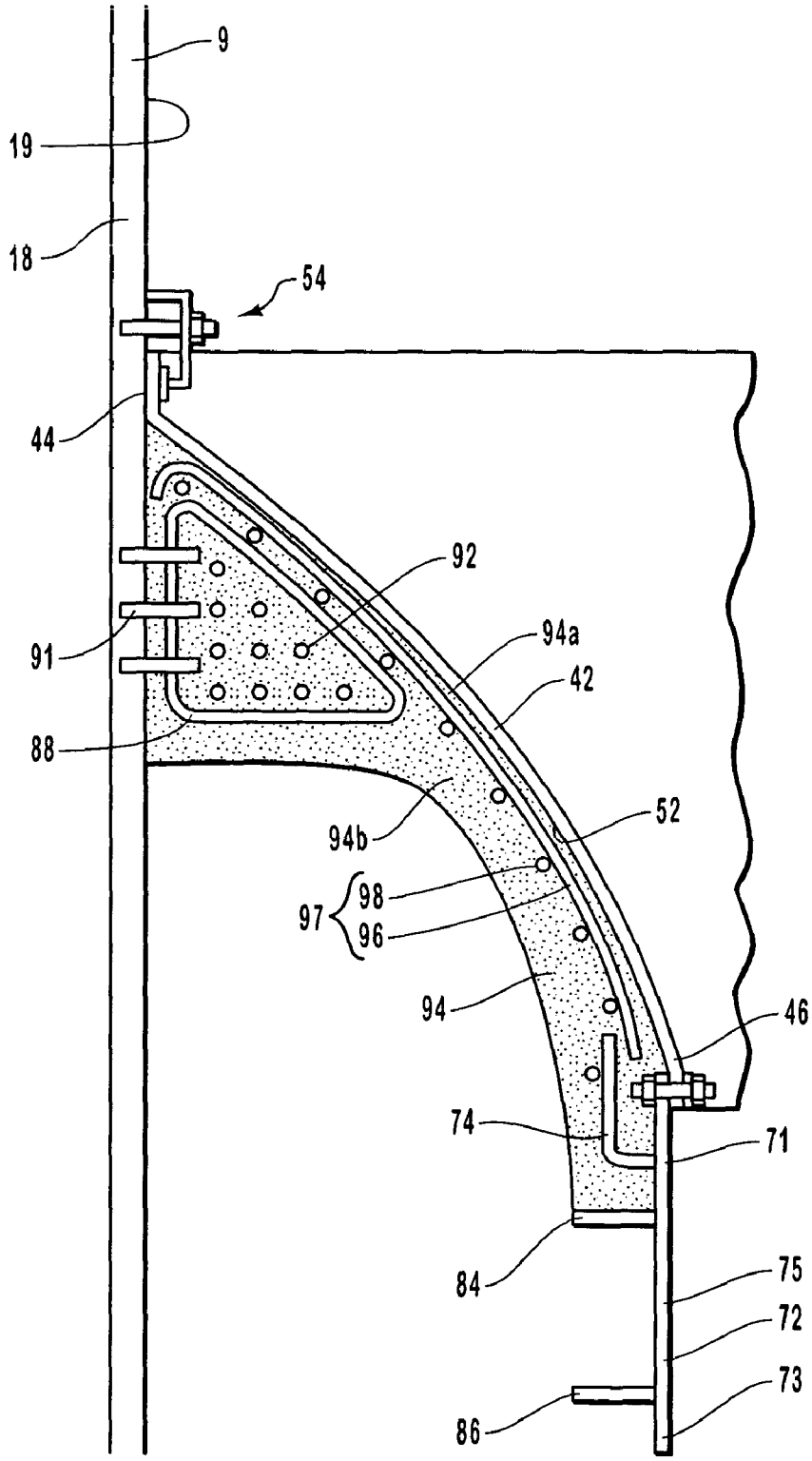
FIG. 8 is an enlarged side view of a portion of assembly shown in FIG. 6.

Turning to FIG. 8, once form 42 and frame assembly 88 are secured to boundary wall 18 of storage structure 9, a support layer 94 is applied over exterior surface 52 of form 42. Specifically, support layer 94 extends from where first end 44 of form 42 intersects with boundary wall 18 down past second end 46 of form 42 to upper flange 84 of outlet assembly 72. In this regard upper flange 84 functions as a boundary wall for support layer 94. Support layer 94 also covers frame assembly 88 so as to fill the spaces between frame assembly 88 and each of boundary wall 18 and form 42. The thickness of support layer 94 is dependent on location and desired strength properties. In one embodiment the thickness is typically in a range between about 15 cm to about 30 cm, although other dimension can also be used.

Support layer 94 is typically comprised of a cementitious material. As used in the specification and appended claims, the term "cementitious material" is intended to include any material that includes cement. Cementitious materials typically include graded sand and/or any number of conventional additives such as fillers, gravel, fibers, hardeners, chemical additives or others which function to improve properties relating to strength, finishing, spraying, curing, and the like. In one embodiment, the cementitious material comprises sprayable, commercially available cementitious material such as "Gunite" or "Shotcrete".

For efficiency, it is desirable that the cementitious material be sprayable. For example, the cementitious material can be applied through a hose at high velocity which results in dense material having a cured compressive strength in a range between about 5,000 psi (3,500 Pa) to about 10,000 psi (7,000 Pa). Alternatively, support layer 94 can be applied by hand, such as by use of a trowel, or other techniques.

Although support layer 94 can be formed as a single application layer, support layer 94 is typically comprised of multiple overlapping sub-layers. For example, support layer 94 comprises a first sub-layer 94*a* and a second sub-layer 94*b* applied over the top thereof. The various sub-layers 94*a*, 94*b* of support layer 94 can be comprised of the same or different materials. Likewise, cementitious materials of different grade or properties can be used. Although not required, each successive sub-layer 94*a*, 94*b* of support layer 94 is typically applied before the previous sub-layer is allowed to cure completely so as to effect maximum bonding between the successive sub-layers.

As depicted in FIG. 8, a reinforcing mat 97 is embedded within support layer 94. Reinforcing mat 97 can be comprised of conventional steel rebar or other types of reinforcing, such as metal cable, wire, mesh, and the like, used in concrete and other cementitious materials. In the embodiment depicted, reinforcing mat 97 comprises a plurality of radially spaced apart vertical rebar 96 that extend from toward first end 44 of form 42 to toward second end 46 of form 42. Vertical rebar 96 are secured to frame assembly 88 at one end and to stud anchors 74 of outlet assembly 27 at the opposing end. Connecting vertical rebar 96 to stud anchors 74 helps to rigidly secure support layer 94 to outlet assembly 72. Conventional ties or other fasteners are used to secure vertical rebar 96 so that they are spaced apart from form 42.

Reinforcing mat 97 also comprises vertically spaced apart horizontal rebar 98 that encircle vertical rebar 96 and form 42. In one embodiment, horizontal rebar 98 form discrete loops which are held in place by conventional ties or other fasteners connecting horizontal rebar 98 to vertical rebar 96. In this embodiment, horizontal rebar 98 function to radially draw in vertical rebar 96 so that both vertical rebar 96 and horizontal rebar 98 contour with form 42.

It is appreciated that depending on the size, configuration, and other engineering requirements of hopper 22, reinforcing mat 97 can be comprised of members of one or more different sizes and can be used at different locations within support layer 94. Furthermore, reinforcing mat 97 can be positioned at one or more different spacings at different locations within support layer 94. For example, since the first end 26 of hopper 22 carries more weight, reinforcing mat 97 is typically larger and/or closer together at first end 26 of hopper 22 than at second end 28. In yet other embodiments, it is appreciated that reinforcing mat 97 can be placed in two or more outwardly spaced apart layers. It is appreciated that the type and/or size of reinforcing mat 97 may differ between different layers. The type and number of reinforcing mat 97 and sub-layers 94 will vary depending on the engineering requirements of a particular hopper assembly 10.

In one method of formation, first sub-layer 94*a* is applied over form 42 prior to placement of reinforcing mat 97. Reinforcing mat 97 is then placed adjacent to the exposed surface of first sub-layer 94*a*. Second sub-layer 94*b* is then applied over reinforcing mat 97. It is appreciated that reinforcing mat 97 and the various sub-layers of support layer 94 can be applied in a variety of different steps. For example, reinforcing mat 97 can be placed prior to the application of first and second sub-layers 94*a* and 94*b*.

Although not required, in one embodiment to help ensure that support layer 94 initially secures to exterior surface 52 of form 42 as support layer 94 is initially applied thereto, a bonding agent 99 (FIG. 7) is applied in a layer over exterior surface 52 of form 42. In one embodiment, bonding agent 99 comprises an acrylic latex bonding agent such as V-COAT available from Diamond Vogel Paint out of Orange City, Iowa. In other embodiments, bonding agent 99 can simply comprise as rewettable bonding agent that has adhesive properties when hydrated so as to help stick support layer 94 to form 42.

In one embodiment, the combination of reinforcing mat 97 and support layer 94 form sidewall 30 of hopper 22. Likewise, frame assembly 88 and the cementitious material formed thereon form support beam 24. Hopper 22 is integrally formed with and supported by support beam 24. Bolts 91 which secure frame assembly 88 to boundary wall 18 of storage structure 9 transfer loads from hopper 22 to boundary wall 18 of storage structure 9.

Figure 9:
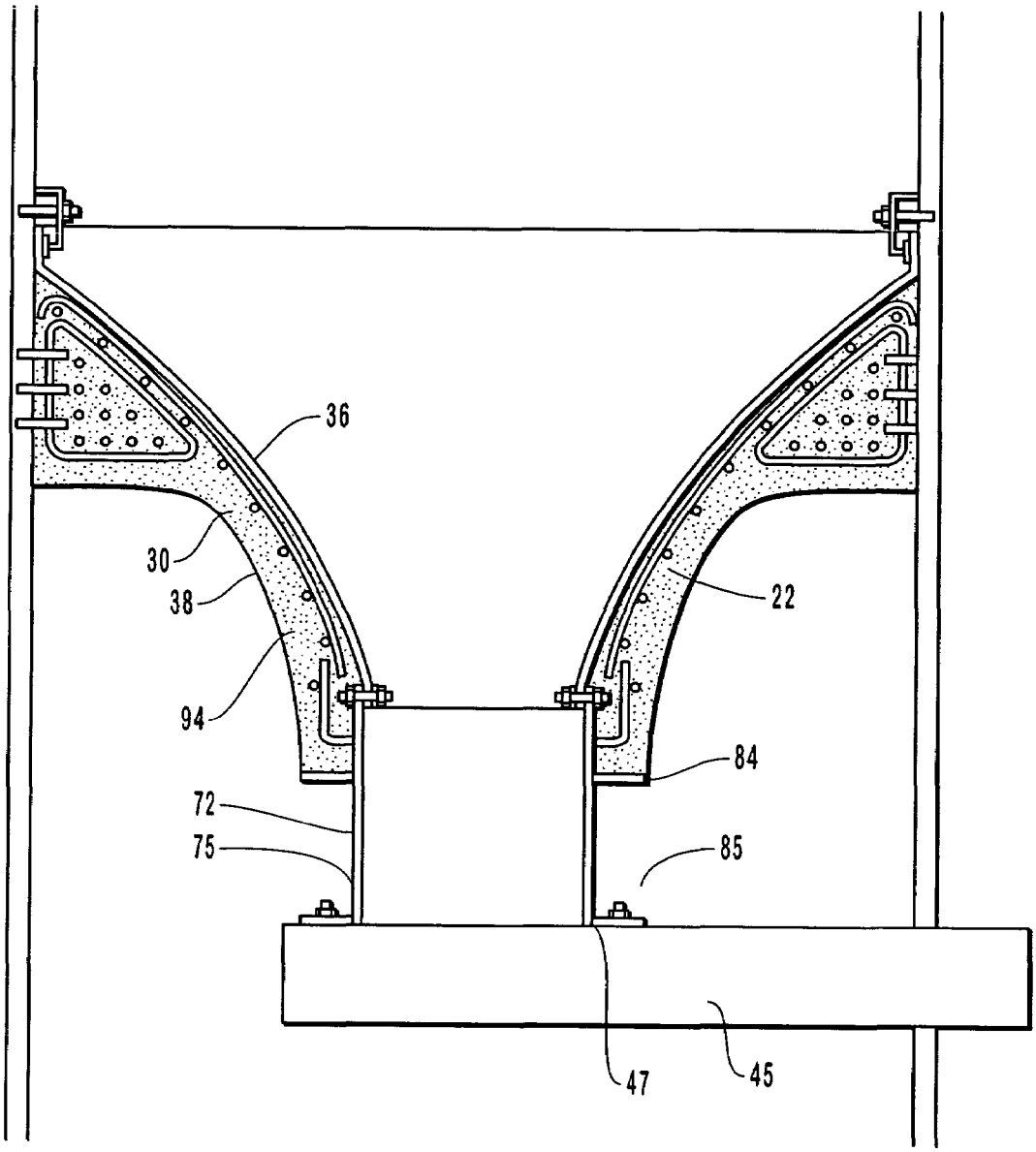
FIG. 9 is a cross-sectional side view of the hopper assembly shown in FIG. 8 attached to a bulky feeder.

With reference to FIG. 9, once support layer 94 has sufficiently hardened, form 42 is removed and either reused or discarded. If interior surface 36 of hopper 22 is sufficiently smooth for design parameters, hopper 22 is finished. Alternatively, if interior surface 36 is not sufficiently smooth, interior surface 36 or portions thereof can be sandblasted following which a surface hardening coating is applied over interior surface 36 so as to decrease the friction coefficient. In one embodiment the surface hardening coating comprises a polymeric layer such as polyurethane. In other embodiments, the surface hardening coating can comprise a layer of cementitious material or other bonding agent having an hardened filler such as steel shot or trap rock. It is also appreciated that these hardened fillers can be directly incorporated into sublayer 94*a* so as to harden interior surface 36 of hopper 22. In one alternative, form 42 may be retained on hopper 22 and, if desired, coated to provide a smooth surface.

The above discussed method for manufacturing hopper 22 comprises using a form 42 which is flexible. The present invention also envisions that form 42 can be rigid. For example, form 42 can be comprised of conventional concrete form materials such as plywood, chipboard, metal sheets, or other substantially rigid forms that can be either prefabricated or constructed on site. In either event, once form 42 is created, support layer 94 is applied to the exterior or bottom surface of form 42 so as to produce hopper 22 as discussed above. Thus, in one embodiment form 42 can comprise a one-sided form wherein a cementitious support layer 94 can be sprayed on form 42 without producing any significant hydrostatic pressure on form 42. It is appreciated that where form 42 is made of a hard material such as metal, form 42 can be retained as the interior surface of hopper 22 on which the bulk material flows.

Once hopper 22 is formed, outlet assembly 72 is coupled with bulky feeder 11. Specifically, as discussed above, conduit 75 is cut to the desired length so that it matches with the intended placement of bulky feeder 11. One of the benefits of having conduit 75 is that it is significantly easier to cut than hopper 22 and it allows for some tolerance in the manufacture of hopper assembly 10. In alternative embodiments, it is also appreciated that hopper assembly 10 can be manufactured without outlet assembly 72. In this embodiment, hopper 22 would couple directly with bulky feeder 11.

Once conduit 75 is cut to the desired length, bulky feeder 11 is positioned within storage structure 9. Lower flange 86 of outlet assembly 72 is then selectively positioned along the length of conduit 75 so as to couple with inlet port 47 of bulky feeder 11. In alternative embodiments it is appreciated that bulky feeder 11 and hopper 22 need not be disposed within storage structure 9 but can be freely exposed.

It is appreciated from the foregoing that hopper assembly 10 can be manufactured quickly and efficiently compared to the prior art. Hopper assembly 10 can also be designed in any configuration optimal for the free flow of bulk material therethrough.

Figure 10:
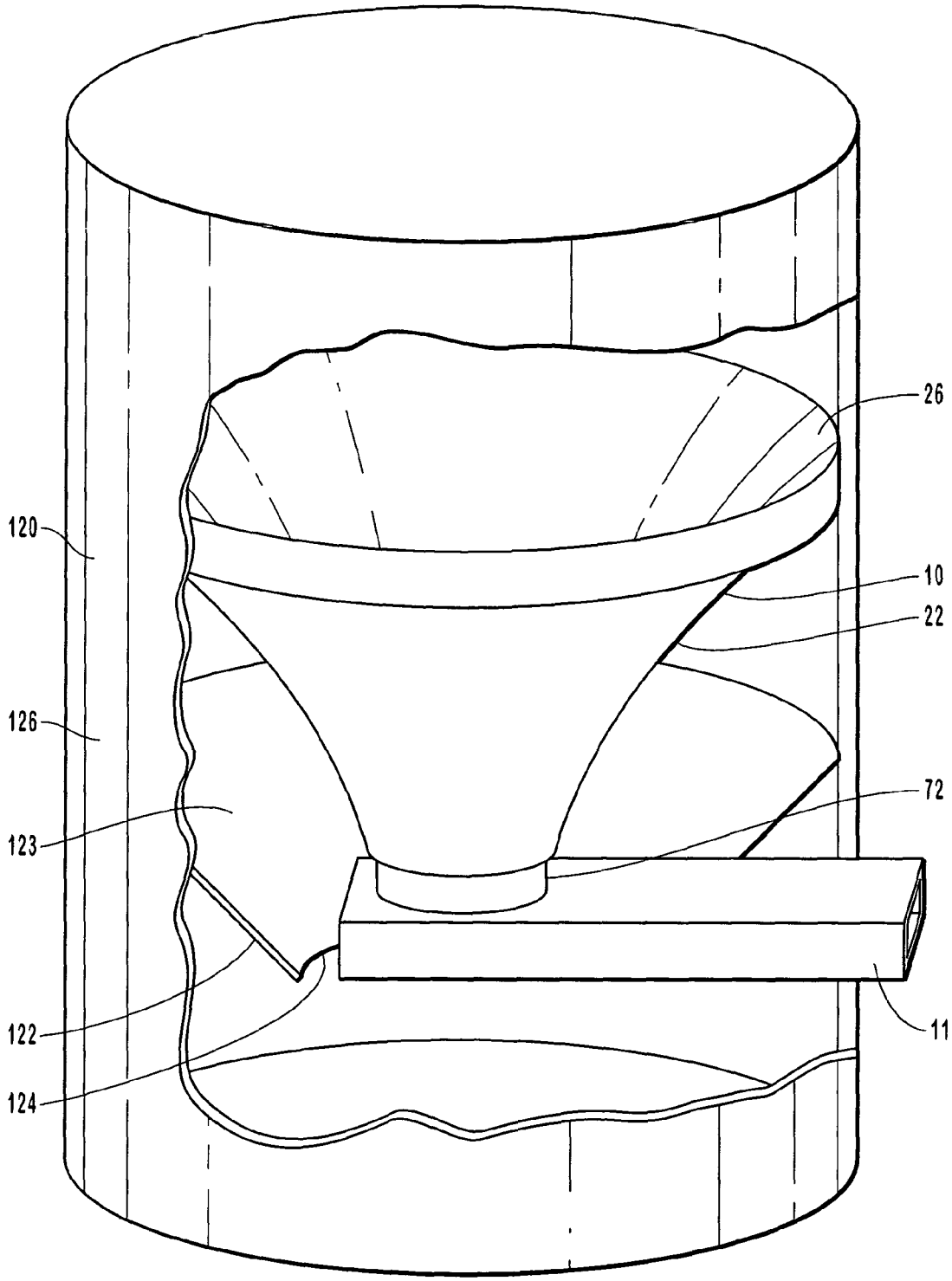
FIG. 10 is a perspective partially cut-away view of a storage structure having the hopper assembly shown in FIG. 9 retrofitted therein.

In addition to forming hopper assembly 10 in a new storage facility, hopper assembly 10 is ideally suited for being retrofitted into an existing storage facility having an inefficient or problematic hopper. For example, depicted in FIG. 10 is a storage structure 120 having an original hopper 122. Initially, an enlarged access is formed in the side of storage structure 120 and bulky feeder 11 is removed therethrough. The lower end of an original hopper 122 is then removed so that only an upper portion 123 mounted to a boundary wall 126 of storage structure 120 remains. By removing the lower portion of original hopper 122, a large opening 124 is formed through which new hopper assembly 10 can extend. Although upper portion 123 of hopper 122 can be removed, upper portion 123 is thicker and more difficult to remove in that it is secured to boundary wall 126. As such, from an efficiency standpoint it is desirable to leave upper portion 123 in place.

Once the optimal design is determined for hopper assembly 10, the location is determined for the placement on boundary wall 126 of first end 26 of hopper 22. The process is then repeated as discussed above with regard to FIGS. 6–9 by securing form 42 to boundary wall 126 of storage structure 120. Once hopper assembly 10 is formed, bulky feeder 11 is inserted back into storage structure 120 and coupled with outlet assembly 72.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hopper for dispensing bulk material from a storage structure, the hopper comprising:

a side wall having an interior surface that bounds a progressively constricting flow channel extending from an enlarged first end to a constricted second end, the side wall being comprised of:

a flexible form;

a cementitious material disposed on the flexible form; and reinforcing embedded within the cementitious material.

2. A hopper as recited in claim 1, wherein the flexible form is comprised of two or more flexible panels that are secured together.

3. A hopper as recited in claim 1, wherein the flexible form is comprised of a flexible sheet.

4. A hopper as recited in claim 3, wherein the flexible sheet is comprised of a polymeric material, fabric, woven material, mesh, chain link, composite material, or combinations thereof.

5. A hopper as recited in claim 1, wherein the interior surface inwardly curves in a convex configuration.

6. A storage structure assembly comprising:

a hopper as recited in claim 1;

a storage structure bounding a compartment, the enlarged first end of the hopper being secured to the storage structure so that the flow channel communicates with the compartment; and a bulky feeder coupled with the constricted second end of the hopper.

7. A storage structure assembly as recited in claim 6, further comprising a tubular conduit extending between the constricted second end of the hopper and the bulky feeder.

8. A storage structure assembly as recited in claim 6, further comprising a support member mounted to the storage structure, the support member being comprised of a cementitious material and be integrally formed with the first end of the hopper so as to support the hopper.

9. A hopper as recited in claim 3, wherein the flexible sheet is comprised of a cross laminated plastic or a reinforced plastic coated fabric.

10. A hopper as recited in claim 1, wherein the flexible form has an exterior surface on which the cementitious material is disposed and an interior surface which bounds the flow channel.

11. A hopper as recited in claim 10, wherein the interior surface of the flexible form and the exterior surface of the flexible form have complementary configurations.

12. A hopper as recited in claim 10, wherein the interior surface of the flexible form and the exterior surface of the flexible form each have a substantially frustoconical configuration.

13. A hopper as recited in claim 10, wherein the interior surface of the flexible form and the exterior surface of the flexible form each have a substantially hyperbolic curvature.

14. A hopper as recited in claim 10, wherein the cementitious material comprises a sprayable concrete that has been sprayed onto the flexible form in multiple layers.

15. A hopper as recited in claim 10, wherein the flow channel bounded by the flexible form has a volume greater than 5 cubic meters.

16. A hopper as recited in claim 10, wherein the flow channel bounded by the flexible form has a volume greater than 40 cubic meters.

17. A storage structure assembly as recited in claim 6, wherein the flexible form is secured directly to the storage structure.

18. A storage structure assembly as recited in claim 7, wherein flexible form is secured directly to the tubular conduit and the cementitious material is disposed on the flexible form and at least a portion of the tubular conduit.

19. A storage structure assembly as recited in claim 6, wherein the bulky feed communicates through a side of the storage structure.

* * * * *

UNITED STATES PATENT AND TRADEMARK OFFICE

CERTIFICATE OF CORRECTION

PATENT NO. : 6,971,495 B2 
APPLICATION NO. : 10/660148
DATED : December 6, 2005
INVENTOR(S) : Hedrick et al.

It is certified that error appears in the above-identified patent and that said Letters Patent is hereby corrected as shown below:

Drawings

Replace FIG. 6 with the figure depicted herein below, wherein the washer has been labeled --112-- and the nut has been labeled --114--

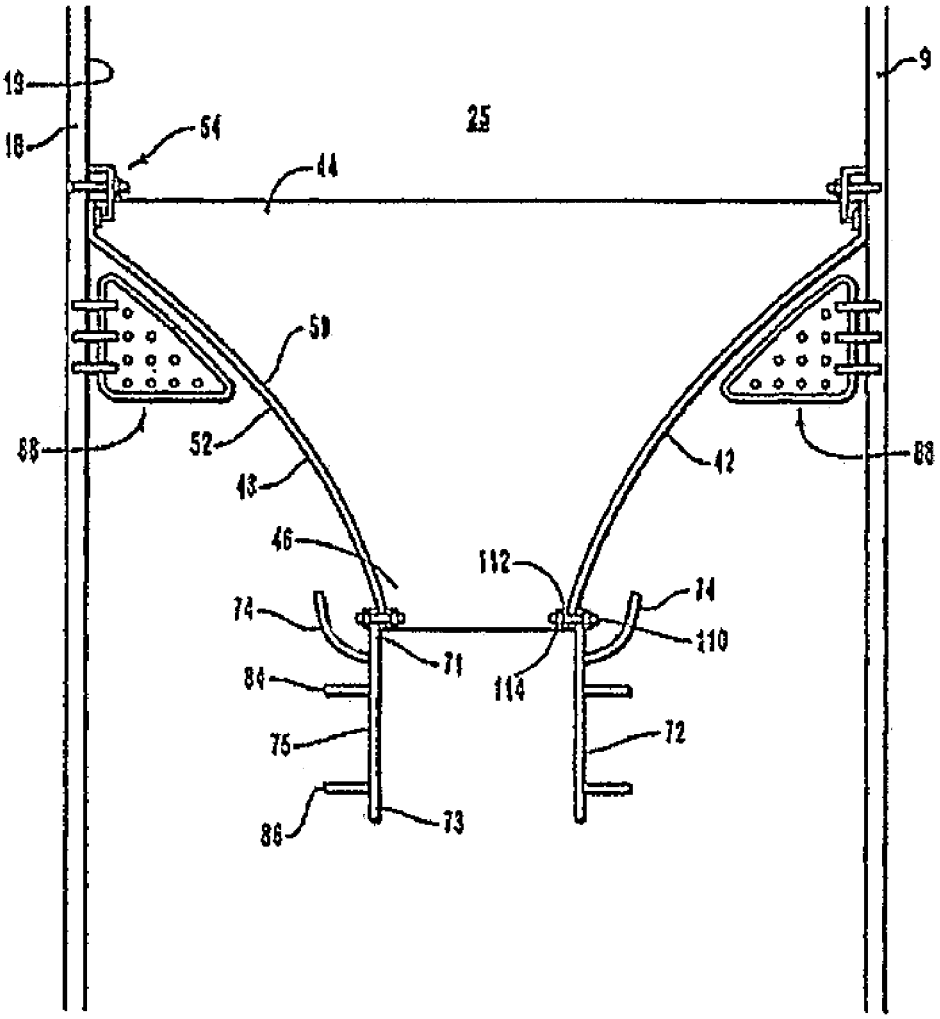

FIG. 6

UNITED STATES PATENT AND TRADEMARK OFFICE

CERTIFICATE OF CORRECTION

PATENT NO. : 6,971,495 B2
APPLICATION NO. : 10/660148
DATED : December 6, 2005
INVENTOR(S) : Hedrick et al.

It is certified that error appears in the above-identified patent and that said Letters Patent is hereby corrected as shown below:

Column 2
Line 22, change “FIG. 8” to --FIG. 7--

Column 3
Line 50, change both instances of “38” to --38a--
Line 51, change “36” to --36a--

Column 4
Line 41, change “19” to --18--

Column 7
Line 21, change “19” to --18--

Column 8
Line 10, change “27” to --72--
Line 59, before “rewettable” change “as” to --a--

Column 10
Line 66, change “be” to --being--

Signed and Sealed this

Sixteenth Day of October, 2007

JON W. DUDAS
*Director of the United States Patent and Trademark Office*